US005810246A

United States Patent [19]

Côté et al.

[11] Patent Number: 5,810,246

[45] Date of Patent: Sep. 22, 1998

[54] EXTERNAL GAS-FIRED WATER/GLYCOL HEATER

[75] Inventors: Charles Côté , Montreal; Henry Nachaj, Kirkland; Kébir Ratnani, Boucherville, all of Canada

[73] Assignee: Centre des Technologies du Gaz Naturel, Boucherville, Canada

[21] Appl. No.: 724,310

[22] Filed: Oct. 1, 1996

[51] Int. Cl.[6] ..... F24D 3/08

[52] U.S. Cl. ..... 237/19; 122/367.1; 122/367.3

[58] Field of Search ..... 122/367.1, 367.2, 122/367.3; 237/19

[56] References Cited

U.S. PATENT DOCUMENTS

| | | | |
|---|---|---|---|
| 2,452,656 | 11/1948 | Holthouse | 122/367.3 |
| 3,242,910 | 3/1966 | Hale | 122/367.1 |
| 3,734,064 | 5/1973 | Cancilla et al. | 122/367.3 |
| 3,767,894 | 10/1973 | Berger | 237/19 |
| 3,823,704 | 7/1974 | Daugirda et al. | 122/235.11 |
| 4,222,350 | 9/1980 | Pompei et al. | 122/367.3 |
| 4,401,058 | 8/1983 | Charrier et al. | 122/367.3 |
| 4,925,093 | 5/1990 | Moore, Jr. et al. | 237/19 |
| 5,020,721 | 6/1991 | Horne | 237/19 |
| 5,074,464 | 12/1991 | Moore, Jr. et al. | 237/19 |
| 5,203,500 | 4/1993 | Horne, Sr. | 237/19 |
| 5,311,843 | 5/1994 | Stuart | 122/367.3 |
| 5,365,888 | 11/1994 | Aronov | 122/367.1 |

*Primary Examiner*—Teresa J. Walberg
*Assistant Examiner*—Jiping Lu
*Attorney, Agent, or Firm*—Swabey Ogilvy Renault; Guy J. Houle

[57] ABSTRACT

An external gas-fired heater for heating a water/glycol fluid is comprised of a housing having a combustion chamber therein. The chamber has a coil through which the water/glycol fluid is circulated and heated by a cylindrical gas burner disposed inside the coil with the coil spaced thereabout. The housing is adapted for mounting outside a building to which the heated fluid is convected for heat exchange with heating devices contained within the building. A cover is removably secured to the housing for access to the internal heater devices and is equipped to convect air within the housing for the air-gas mixing blower. Quick connect couplings permit the housing to be easily removed and replaced, if necessary. The cover also provides ease of access to the heater devices for servicing or replacement.

10 Claims, 4 Drawing Sheets

EXTERNAL GAS-FIRED WATER/GLYCOL HEATER

TECHNICAL FIELD

The present invention relates to an external gas-fired heater and particularly, but not exclusively, incorporating a natural gas heater for heating a water/glycol fluid and wherein the heater is provided within a housing which precludes unauthorized access thereto and still further wherein the heater is easy to repair or replace.

BACKGROUND ART

Heating devices for heating homes or small buildings having heating capacities of from about 70,000 to about 150,000 Btu are usually mounted internally of such buildings and such have inherent disadvantages. For example, the furnace or heater occupies interior space in the building and often a specific furnace room has to be provided for security. It is also necessary to have a fresh air duct connected to such furnace and this often results in excessive cold air intrusion within the building, as the air duct must penetrate the outside wall of the building. These heaters or furnaces also generate noise and release gas or oil scent within the building. It is also necessary to construct a chimney to evacuate the combustion products from the furnace, and if there are leaks in the piping which connects the furnace to the chimney, then this could cause serious health problems to the occupants of the building. Another problem with some of these furnaces is that they consume electricity, which is a high-cost commodity, as compared to natural gas. A still further disadvantage of such furnace is that they are often difficult to repair or replace. The efficiency of some of these known furnaces can also be inferior to 80%. Furthermore, some of these furnaces are unsightly, and thus the need to locate them in a special furnace room. They are sometimes accessible to children, and this also poses a hazard.

SUMMARY OF INVENTION

It is a feature of the present invention to provide an external gas-fired heater which substantially overcomes the above-mentioned disadvantages noted with some prior art heaters or furnaces.

Another feature of the present invention is to provide an external gas-fired heater which is secured externally of a building to be heated and which is easy to service, repair and replace.

Another feature of the present invention is to provide an external gas-fired heater which has an efficiency superior to 83% and a low $NO_X$ emission inferior to 30 ppm at 3% of $O_2$.

Another feature of the present invention is to provide an external gas-fired heater which is easy to use and which has an esthetically pleasing design.

Another feature of the present invention is to provide an external gas-fired heater which is safe for children and access to which is provided only to authorized people.

Another feature of the present invention is to provide an external natural gas-fired heater for heating a water/glycol fluid to produce a heat exchange medium to feed heat exchange devices located inside a building to be heated by the heater.

According to the above features, from a broad aspect, the present invention provides an external gas-fired heater for heating a fluid for use as a heat exchange medium. The heater comprises a housing securable outside a building to which heated fluid is to be supplied for heat exchange in heating devices contained within said building. A heating coil is supported in the housing and through which is convected the fluid. A combustion chamber contains the heating coil. A cylindrical gas burner is disposed inside the coil to heat the coil and the fluid. An air/gas mixing blower is connected to the gas burner to feed a combustible air/gas mixture thereto. Exhaust means is provided to evacuate flue gases from the combustion chamber to atmosphere. An ignitor is provided to ignite the air/gas mixture at the gas burner. A flame detector is provided to detect a flame at the gas burner. The housing has an access panel to permit access to the interior of the housing. Lock means secures the panel to the housing. Convection means provides air circulation inside the housing. Coupling means permit use of installation and removal of the housing or equipment therein.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
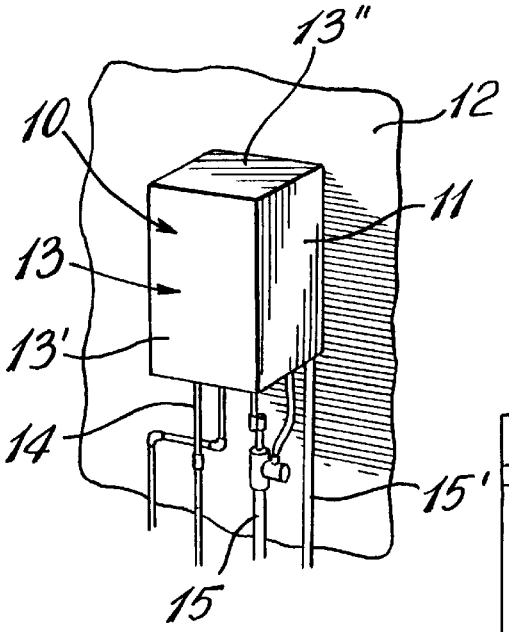
FIG. 1 is a perspective view of the external gas-fired heater housing of the present invention secured to a wall of a building.
Figure 2:
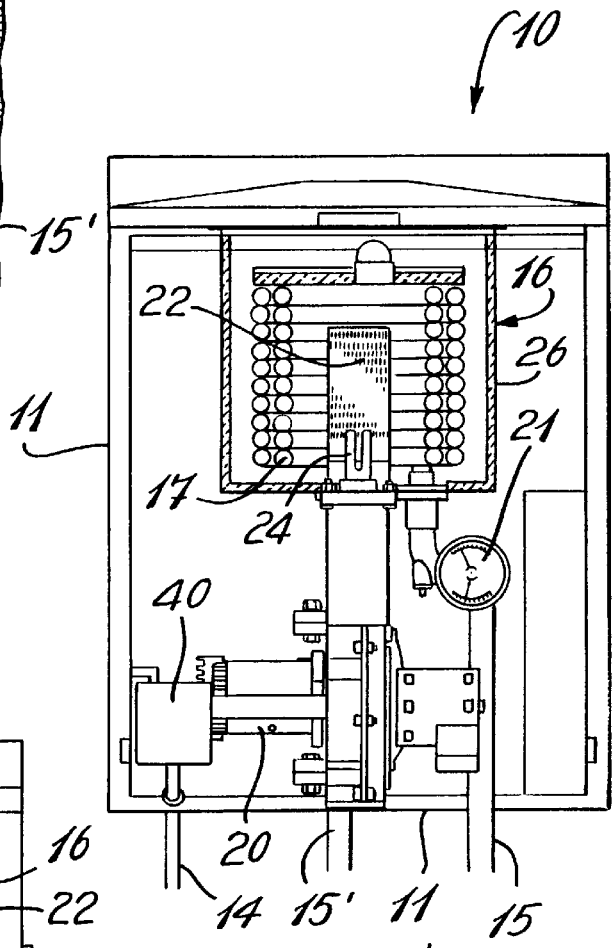
FIG. 2 is a fragmented front view of the external gas-fired heater of the present invention.

Referring now to the drawings, and more particularly to FIG. 1, there is shown generally at 10 the external natural gas-fired heater of the present invention housed within a housing 11 which is secured to the wall 12 of a building or roof unit. As herein shown, the housing 11 is a rectangular housing provided with a detachable cover 13 which forms the front wall 13' and top wall 13" of the housing whereby to provide access to the component parts of the heater and to provide security. Feed pipe 14 supplies the natural gas to the internal burner, as will be described later, and pipes 15 provide circulation of a heated liquid to the building for heat exchange with heaters (not shown) provided therein.

Referring now to FIGS. 2 to 7, there will be described a construction of the external gas-fired heater 10 of the present invention. As herein shown, a thermally insulated combustion chamber 16 is secured in an upper portion of the housing 11 and has a heating coil 17 mounted therein. In this particular embodiment the heating coil is comprised of two concentrically disposed spiral coils 17' and 17" of heat conductive material, and which are serially connected to one another, and have an inlet 18 and an outlet 19 through which a water/glycol mixture is circulated by a pump 20. A temperature and pressure gauge 21 monitors the glycol solution at the outlet of the coil.

A cylindric natural gas burner 22 is supported concentrically at the center of the heating coil 17 and is supplied a natural gas/air mixture by the mixing blower 23 to heat the spiral coil 17', 17", and hence the water/glycol liquid solution circulated therethrough. Ideally, this solution is a 50/50 mixture. Of course, other suitable solutions may be used, but it has been found that the particular glycol/water mixture provides for the mixture to be operational from about −40° F. to about 180° F. making it ideal for harsh northern climates. An ignitor 24 ignites the cylindrical burner 22 and a flame is detected by a flame detecting probe 25 mounted adjacent the burner 22. Controls for these are provided on a control panel 45.

Figure 5:
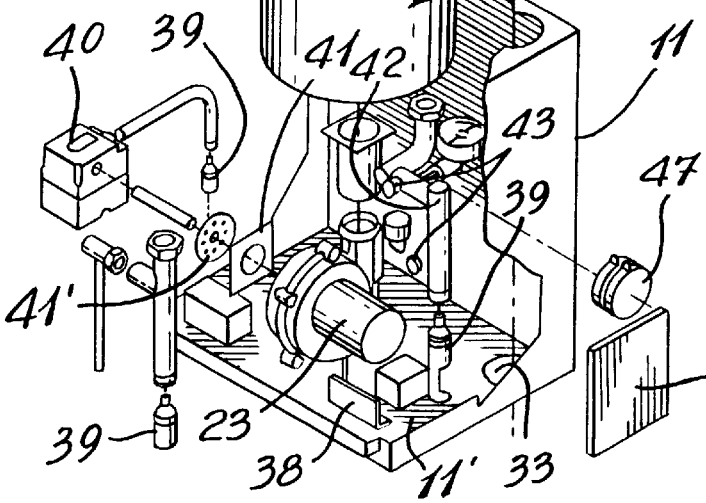
FIG. 5 is an exploded view showing the basic component parts of the external gas-fired heater.

As better seen in FIG. 5, the combustion chamber 16 is comprised of a thermally insulated cylindrical metal container 26 having a bottom wall and on which is disposed a bottom circular refractory disc 27. A top refractory disc 28 is disposed over the heating coil 17 to reduce heat loss from the container and to increase the exchange efficiency of the heater. A top wall 29 is secured over the top end 26' of the cylindrical container 26. The refractory disc 28 is a solid disc to force the flue gas through the heating coil spirals and up above the disc 28 periphery and then through the evacuating portion the wall 29.

The flue gases which are convected through the port 29' is directed into an exhaust duct which, as shown in FIG. 5, is constituted by an intake pipe 30 which interconnects the port 29' to an exhaust conduit 31 which extends through the housing 11 from a top end to a bottom wall 11' of the housing. The outlet end 32 of the exhaust pipe 31 communicates the flue gases to atmosphere through an orifice 33 provided in the bottom wall 11'. This exhaust pipe 31 also pre-heats air within the housing to feed warm air to the mixing blower 23 to increase the efficiency of the combustion mixture thereof.

Figure 6:
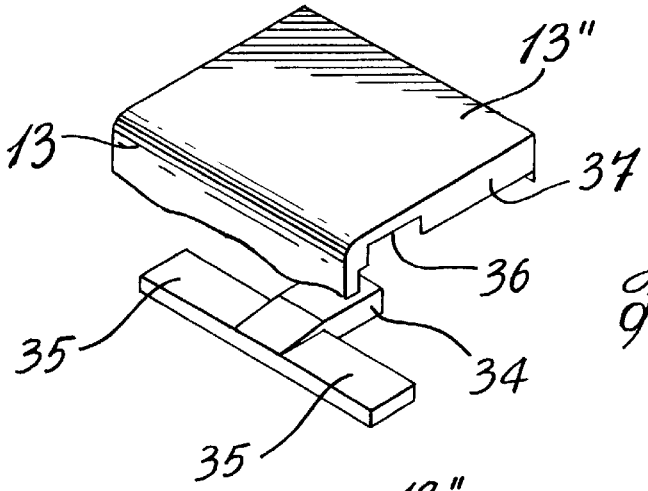
FIG. 6 is a fragmented perspective view showing a modification of the exhaust conduit secured to the top end of the combustion chamber.

FIG. 6 illustrates an alternative embodiment of the exhaust conduit for use in less cold climatic regions and, as herein shown, it may be provided by an intake pipe 34 secured about the port 29' of the top wall 29 of the combustion chamber, and having diametrically opposed exhaust ducts 35 to release the combustion products from the opposed sides of the top wall 13" of the cover 13. As herein shown, the top wall has notches 36 on opposed side walls 37 thereof to accommodate the ducts 35.

As is better shown in FIG. 5, the various component parts of the heater are individually removably secured within the housing 11 by individual attachment brackets, such as bracket 38 and quick connectors 39, to permit the entire housing and its component parts and wiring to be removed in a very short period of time for replacement and/or for servicing elsewhere than on site if need be. These quick connectors connect the gas pipes and heating fluid pipes. As shown in FIG. 5, the gas pipe feeds a gas valve, 40 and an interchangeable orifice plate 41 regulates the amount of gas which is fed to the blower 23 for admixture with air. The gas supply and orifice plate are connected to blower 23 by a orifice plate 41'. A pressure control switch 42 and a temperature limiting probe 43 are secured to the heated fluid pipes 15,15'. An air/gas mixture control 47 is provided on the control panel 45, and this control panel is mounted internally of the housing 11 and is accessible only to authorized personnel who have access to the key lock 50.

Figure 7:
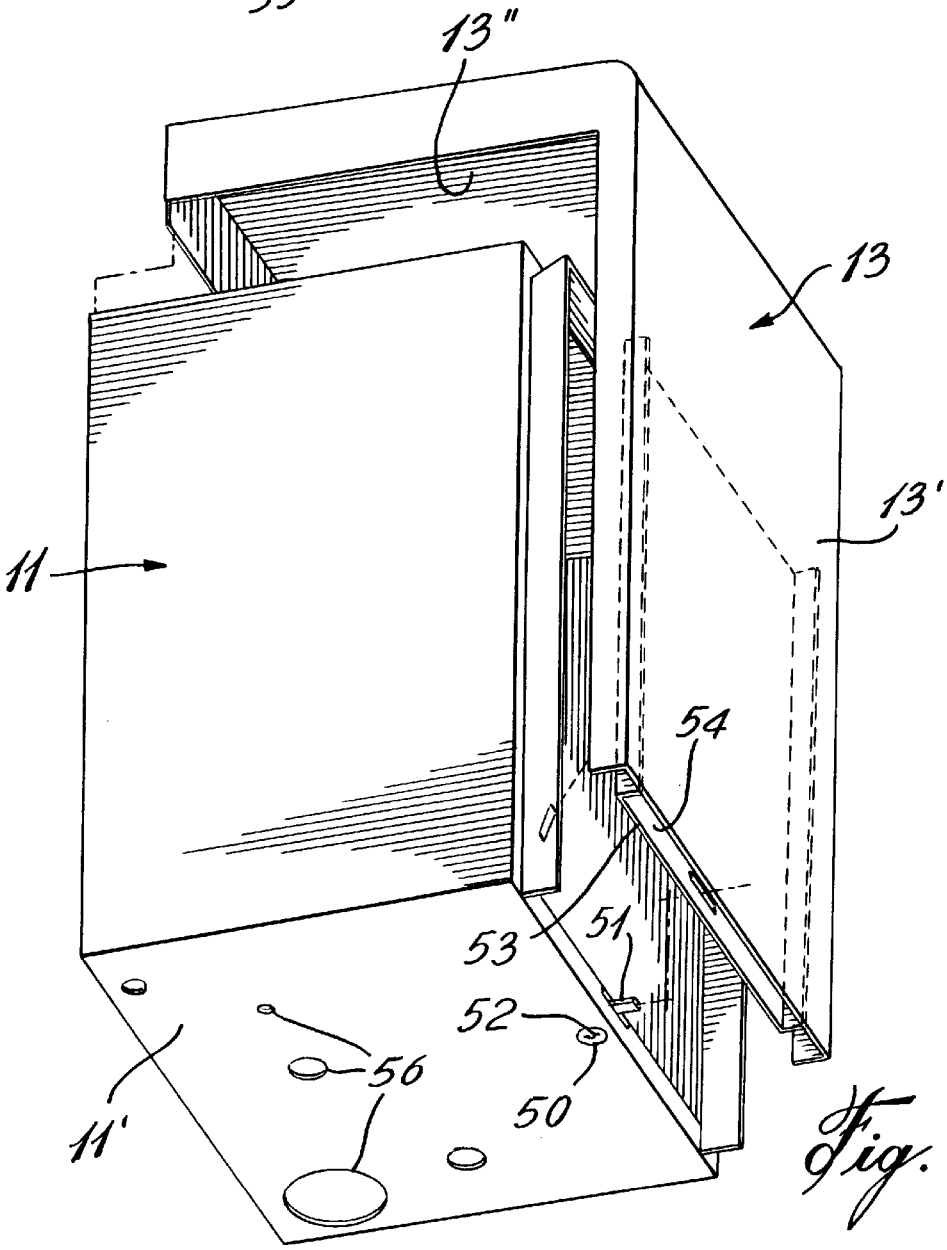
FIG. 7 is an exploded perspective view showing the construction of the housing.

As previously described and as better shown in FIG. 7, the housing 11 is a rectangular housing having an L-shaped removably detachable cover 13. Lock means in the form of a key operated lock cylinder 52 capable of actuating a locking element 51, when a key is positioned and operated in the key hole secures the cover 13 to the rectangular housing 11. The front wall 13' of the cover 13, in a lower inner section thereof, is provided with a spaced internal metal wall 53 to form a narrow convection passage 54 to feed air internally of said housing adjacent the top end of the cover, as shown in FIG. 1. Access holes 56 are punched in the bottom wall 11' of the housing to accommodate the necessary piping and wiring.

The heater, as above described, has a heating capacity of about from 30,000 to 200,000 Btu/h and is easily adjustable by interchanging the orifice plate 41 to deliver the required heat capacity within that range. The housing 11 is also mounted on an exterior wall of a building to which the hot water/glycol solution is to be fed.

Figure 8:
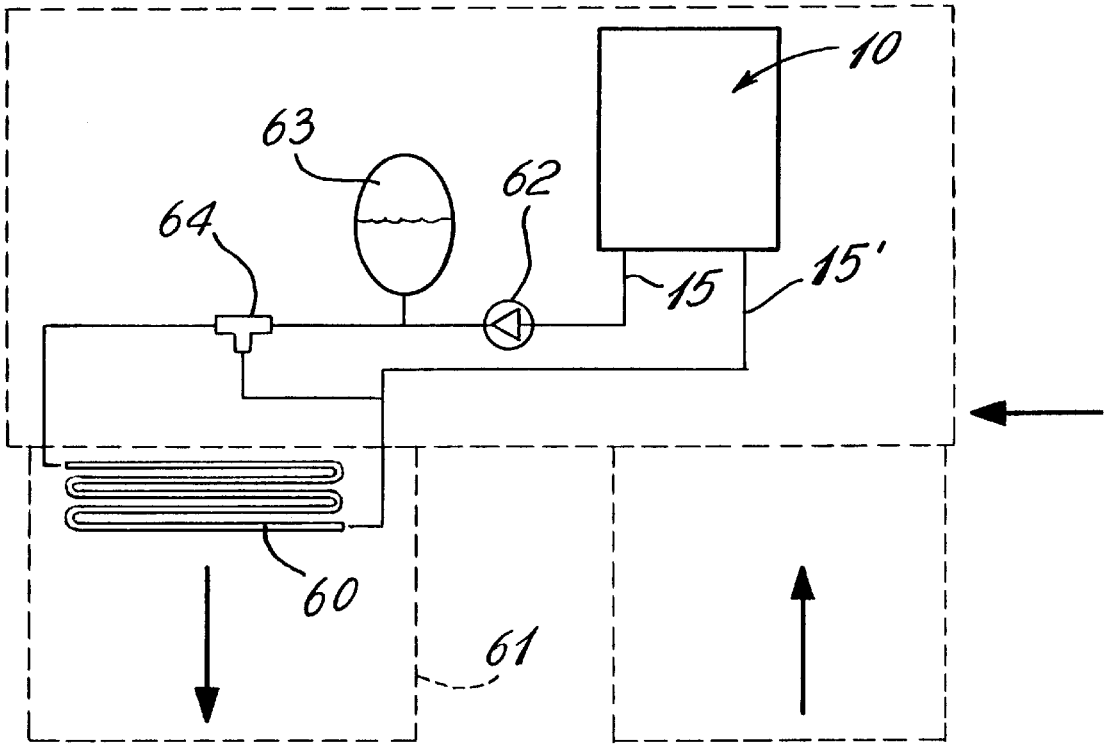
FIG. 8 is a simplified schematic view showing the external gas-fired heater utilized on a roof unit for buildings.

FIG. 8 shows a typical embodiment wherein the heater 10 is mounted on the roof unit of a building. The feed line 15 of the water/glycol solution is fed to a heat exchange device 60 located inside the duct work 61 and through which air is circulated to heat the air. An expansion tank 63, as is well known in the art is connected in the line 15. A mixing valve 64 is also secured to the fluid pipe 15 to prevent passage of cold water/glycol solution. The hot glycol solution is circulated through the heat exchange coil 60 where it cools and is then returned to the heating coil 17 through the return pipe 15'. As can be noted, the advantage of the heater being mounted externally of the housing results in a saving of space within the building and the air supply for the heater is taken directly from the outside air. Accordingly, there is no intrusion of air within the building by convection ducts. Furthermore, the noise generated by the heater is located outside the building and the gases are evacuated directly to the atmosphere, thus avoiding the necessity of building a chimney. Such a heater can also be utilized to replace existing electric heaters by natural gas heaters. The heater is also easy to operate and provides of ease of maintenance.

Figure 3:
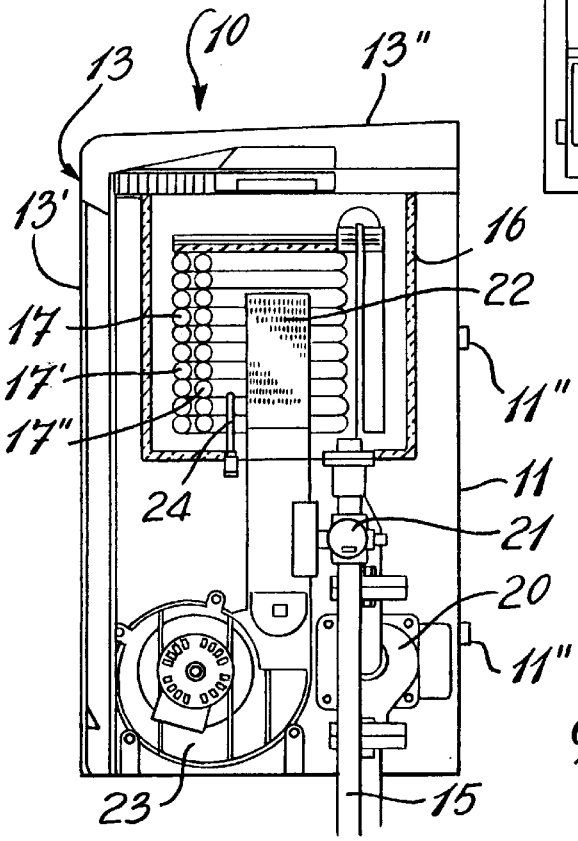
FIG. 3 is a fragmented side view of FIG. 2.
Figure 4:
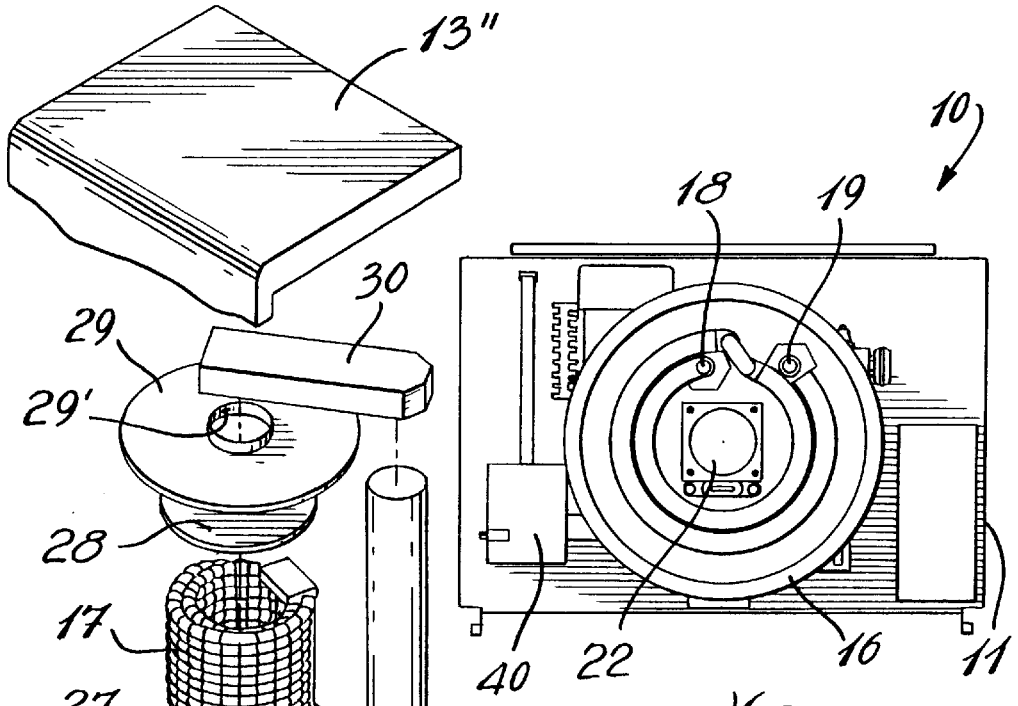
FIG. 4 is a sectional top view of FIG. 2.

It has been found that the efficiency of the heater of this invention is superior to 83% and that the $NO_X$ emission is inferior to 30 ppm at 3% $O_2$. The construction of the heater housing is also aesthetically pleasing to the eye and provides added safety by locking the heater components inside a housing which is accessible to authorized persons only. Because the housing is wall-mounted, such as on support brackets 11" as shown in FIG. 3, it can be secured at a convenient height for maintenance and above the snow line to provide ease of service in winter. The heater of the present invention also results in a reduction in cost of operation as compared to electricity. It also provides a more compact housing than competitive heaters. It may also be used to heat water or swimming pools, radiant floors, radiators and a multitude of other devices or may have other uses. It is pointed out that tests have shown that the external gas-fired heater of the present invention has a jacket heat loss of only about 2%. It is also feasible to utilize the gas-fired heater for applications in buildings having three rooms only or to triplex-type buildings where there may be 15 to 20 rooms. The units can also be fabricated in different sizes to supply from about 30 to 200,000 Btu or from 40 to about 200,000 Btu.

It is within the ambient of the present invention to cover any other obvious modifications of the example of the preferred embodiment described herein, provided such modifications fall within the scope of the appended claims.

We claim:

1. An external compact gas-fired heater for heating a fluid for use as a heat exchange medium, said heater comprising a rectangular housing securable outside a building to which a fluid to be heated is supplied, heated and fed as a heat source to heating devices contained within said building; said heater being removably connected to said housing, a heating coil supported in said housing through which is convected said fluid, a cylindrical combustion chamber is comprised of a thermally insulated cylindrical container having a top and bottom circular refractory wall, said combustion chamber containing said heating coil, a cylindrical gas burner disposed inside said coil to heat said coil and said fluid, an air/gas mixing blower connected to said gas burner to feed a combustible air/gas mixture thereto to maintain a stable flame in the presence of ambient climatic conditions, said heat exchange medium operating within a temperature range of from about −40° F. to about 180° F. to provide a heating capacity of from about 30,000 to about 200,000 Btu/h, an exhaust is secured to said top end of said combustion chamber and provided with exhaust outlet means to evacuate said flue gases from said combustion chamber to atmosphere outside said housing, an ignitor to ignite said air/gas mixture at said gas burner, a flame detector to detect a flame at said gas burner, said housing having an access panel to permit complete access to the interior of said housing, lock means for ease of securement and removal of said panel to said housing, convection means to provide air circulation inside said housing, and coupling means to permit ease of installation and removal of said housing and said equipment therein, said access panel being a cover for said housing and constituting a front and top wall of said housing, said heater being constructed as a component parts assembly removably secured within said housing by fasteners made accessible from a front and top portion of said housing when said cover is removed.

2. An external gas-fired heater as claimed in claim 1 wherein said heat exchange medium is a water and glycol liquid solution.

3. An external gas-fired heater as claimed in claim 2 wherein said water and glycol liquid solution is substantially a 50/50 mixture of water and glycol.

4. An external gas-fired heater as claimed in claim 1 wherein said lock means is a key operated lock cylinder actuating a locking element to secure said access panel to said housing.

5. An external gas-fired heater as claimed in claim 1 wherein said exhaust means is comprised by an exhaust conduit having an intake end secured at a top end of said combustion chamber and an outlet end secured to a wall of said housing to evacuate said flue gases to atmosphere outside said housing, said exhaust conduit extending inside said housing for heating air in said housing at least in the area of said mixing blower and thereby providing pre-heated air to said mixing blower to enhance combustion of said air/gas mixture.

6. An external gas-fired heater as claimed in claim 1 wherein said heating coil is a spiral coil having a plurality of spirals, said coil having an inlet end and an outlet end, said coupling means including a rapid-type connector secured at said inlet and outlet ends.

7. An external gas-fired heater as claimed in claim 6 wherein said heating coil is comprised of two concentrically disposed ones of said spiral coils connected in series with one another.

8. An external gas-fired heater as claimed in claim 1 wherein said convection means is provided by a section of said panel being formed as a convection channel by two spaced apart metal sheets formed in a lower front end portion of said panel.

9. An external gas-fired heater as claimed in claim 8 wherein said convection means is formed with said front wall of said cover.

10. An external gas-fired heater as claimed in claim 1 wherein said gas burner is a natural gas burner, said flue gases emitting less than about 30 ppm $NO_X$ at 3% of $O_2$.

* * * * *